US012173998B1

(12) United States Patent
Sanford et al.

(10) Patent No.: US 12,173,998 B1
(45) Date of Patent: Dec. 24, 2024

(54) ACTIVE HAZARD MITIGATION DEVICE

(71) Applicant: The United States of America as Represented by the Secretary of the Navy, Indian Head, MD (US)

(72) Inventors: Matt Sanford, Bel Alton, MD (US); Zaeemuddin Husain, LaPlata, MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 18/445,577

(22) Filed: Oct. 30, 2023

(51) Int. Cl.

| | |
|---|---|
| ***F42B 39/14*** | (2006.01) |
| ***F42B 39/20*** | (2006.01) |
| ***F42C 15/184*** | (2006.01) |
| ***F42C 15/36*** | (2006.01) |

(52) U.S. Cl.
CPC ..... *F42B 39/20* (2013.01); *F42B 39/14* (2013.01); *F42C 15/184* (2013.01); *F42C 15/36* (2013.01)

(58) Field of Classification Search
CPC ..... F42B 39/00; F42B 39/14; F42B 39/16; F42B 39/20; F42C 15/00; F42C 15/18; F42C 15/31; F42C 15/36; F42C 15/184
USPC ..... 102/202.1, 481
See application file for complete search history.

(56) References Cited

U.S. PATENT DOCUMENTS 4,709,637 A * 12/1987 Boggero ..... F42B 39/20 102/378
4,843,965 A * 7/1989 Merzals ..... F42B 39/20 102/254
5,445,077 A * 8/1995 Dupuy ..... F42B 39/20 102/481
5,466,537 A 11/1995 Diede et al.
7,377,690 B1 5/2008 Diede
8,230,682 B1 7/2012 Sanford et al.
9,696,125 B2 7/2017 Merems
10,677,576 B1 6/2020 Hansen et al.
(Continued)

FOREIGN PATENT DOCUMENTS

FR 2685079 A1 * 6/1993 ..... F42B 39/20
FR 2699664 A1 * 6/1994 ..... F42B 39/20

OTHER PUBLICATIONS

Machine translation of FR 2685079 A1 (Year: 1993).*
Machine translation of FR 2699664 A1 (Year: 1994).*

*Primary Examiner* — James S Bergin
(74) *Attorney, Agent, or Firm* — Fredric J. Zimmerman

(57) ABSTRACT

An active hazard mitigation device includes a reservoir containing thermal wax and a slider translatable from a safe position to an armed position. A conduit for flow of the thermal wax in a melted state extends from the thermal wax reservoir to a rear of the safe position of the slider. A $BKNO_3$ pellet is disposed in a forward end of the slider. A lithium intermetallic thermal sensor is disposed adjacent the $BKNO_3$ pellet when the slider is in an armed position. When the thermal wax expands, the slider moves from the safe position to the armed position under the lithium intermetallic thermal sensor. When the lithium intermetallic thermal sensor activates, heat from the lithium intermetallic thermal sensor ignites the $BKNO_3$ pellet in the slider and thereby produces gas and heat that ignites energetic material disposed proximate to the $BKNO_3$ pellet.

11 Claims, 8 Drawing Sheets

(56) References Cited

U.S. PATENT DOCUMENTS

| | | | |
|---|---|---|---|
| 10,746,520 | B1 | 8/2020 | Hall et al. |
| 11,644,291 | B1 | 5/2023 | Hansen et al. |

* cited by examiner

ACTIVE HAZARD MITIGATION DEVICE

STATEMENT OF GOVERNMENT INTEREST

The invention described herein may be manufactured and used by or for the Government of the United States of America for Governmental purposes without the payment of any royalties thereon or therefor.

FIELD OF THE INVENTION

The invention relates in general to safety measures for energetic material such as explosives and propellants contained in, for example, warheads and rocket motors, and in particular to the intentional ignition of explosives and propellants during a fire or slow heating scenario (cook off) to prevent a high order detonation.

BACKGROUND OF THE INVENTION

The purpose of active hazard mitigation devices (AHMDs) is to ignite and vent combustion products of explosives or propellants in the event of a fire or slow heating scenario. While ignition of energetics is a non-trivial event and a hazard, it is a desirable alternative to allowing the energetic material to heat to the point of a high order detonation, which would produce both overpressure and deadly high-velocity fragments. Examples of explosives or propellants that require protection from fire or slow heating scenarios include warheads and rocket motors.

AHMDs are broadly categorized as in-line and out-of-line devices, and mechanical or electronic. The Safety Community requirements for AHMDs have evolved over time and are called out in MIL-STD-2105 and JOTP-050A. Because AHMDs are essentially initiators for energetics, the safety requirements somewhat mirror those required for fuze and initiation systems, both mechanical and electronic based. Typical mechanical systems rely on two environmental stimuli to arm and initiate, and are not allowed to contain stored energy for those functions. Electronic based systems are typically in-line and have a number of elaborate safety requirements, and necessarily have a power source with a limited shelf life.

One conventional technology is a Lithium Intermetallic Thermal Sensor (LIMTS). The LIMTS is a chemical based system. Disadvantages of LIMTS devices are the use of an in-line structure, use of a single environment (temperature), and use of a single function (intermetallic reaction) to initiate. Disadvantages of conventional electronic devices are that electric power is required, which limits shelf life, and the operation of electronics at high temperatures is erratic. Disadvantages of some conventional mechanical devices are mechanical complexity and large size.

A need exists for an out-of-line mechanical active hazard mitigation device that is smaller and less complex than conventional mechanical active hazard mitigation devices. The active hazard mitigation device must be safe, reliable, small, and have a shelf life in excess of 15 years.

SUMMARY OF THE INVENTION

One aspect of the invention is an active hazard mitigation device including a generally cylindrical housing having an interior and an exterior. A reservoir is defined in the interior of the housing and contains thermal wax. One end of the reservoir is closed with a cap. A slider is disposed in the interior of the housing and translatable from a safe position to an armed position. A conduit for flow of the melted thermal wax extends from the end of the reservoir opposite the cap to the rear of the safe position of the slider. A $BKNO_3$ pellet is disposed in a forward end of the slider. The forward end of the slider has a generally rectangular prismatic shape with four parallel edges that are chamfered. A lithium intermetallic thermal sensor is disposed in the interior of the housing and has one end closed and an open end adjacent the $BKNO_3$ pellet when the slider is in an armed position. A graphite thermal conductor is disposed in the open end of the lithium metallic thermal sensor.

A pair of positioning pins may be disposed in the interior of the housing on opposite sides of the slider. Each pin may have a spring-loaded ball detent wherein the spring-loaded ball detents interact with the chamfered parallel edges to hold the slider in the safe position and, after arming of the active hazard mitigation device, to hold the slider in the armed position. The thermal wax expands at a first temperature, moving the slider from the safe position to the armed position under the graphite thermal conductor of the lithium intermetallic thermal sensor. When the lithium intermetallic thermal sensor activates and self-heats at a second temperature that is greater than the first temperature, heat from the lithium intermetallic thermal sensor is transferred by the graphite thermal conductor to ignite the $BKNO_3$ pellet in the slider and thereby produce gas and heat that ignites energetic material disposed proximate to the $BKNO_3$ pellet.

A slider stop pin may be disposed in the interior of the housing to limit translation of the slider when the slider has reached the armed position. A thermochromic sticker may be attached to the top of the thermal wax reservoir cap and visible with the naked human eye. The thermochromic sticker may permanently change appearance when the first temperature is reached. A metallized BoPET (Biaxially-oriented polyethylene terephthalate) film may be disposed on opposite flat ends of the $BKNO_3$ pellet.

The exterior of the generally cylindrical housing may include a circumferential flange proximate an upper portion of the generally cylindrical housing. A sleeve that fits around the exterior of the generally cylindrical housing may be provided. The top of the sleeve may include a circumferential lip adjacent the circumferential flange wherein the circumferential lip angles radially inward and cooperates with the circumferential flange to hold a C-clip that resists movement of the generally cylindrical housing out of the sleeve. The sleeve may be inserted into and fixed to a side wall of a casing for holding energetic material.

Another aspect of the invention is a method to ignite and vent energetic material disposed in a casing. The method includes installing the generally cylindrical housing of the active mitigation hazard device of the first aspect of the invention in a sleeve fixed to a side wall of the casing. The thermal wax in the generally cylindrical housing is expanded at a first temperature, which causes the slider to move from the safe position to the armed position under the graphite thermal conductor of the lithium intermetallic thermal sensor. At a second temperature that is greater than the first temperature, the lithium intermetallic thermal sensor is activated. Heat from the lithium intermetallic thermal sensor is transferred via the graphite thermal conductor to ignite the $BKNO_3$ pellet in the slider. The energetic material in the casing is ignited via the gas and heat produced by the $BKNO_3$ pellet and the lithium intermetallic thermal sensor. The generally cylindrical housing and components contained therein are ejected from the sleeve as pressure in the casing increases.

The invention will be better understood, and further objects, features, and advantages thereof will become more apparent from the following description of the preferred embodiments, taken in conjunction with the accompanying drawings.

BRIEF DESCRIPTION OF THE DRAWINGS

In the drawings, which are not necessarily to scale, like or corresponding parts are denoted by like or corresponding reference numerals.

DETAILED DESCRIPTION OF THE INVENTION

Warheads and rocket motors, for example, contain energetic material such as explosives and propellants. In the event of an undesired fire or slow heating scenario (cook off), the purpose of an active hazard mitigation device is to intentionally ignite the explosives or the propellants to prevent a high order detonation of the explosives or the propellants.

Figure 1:
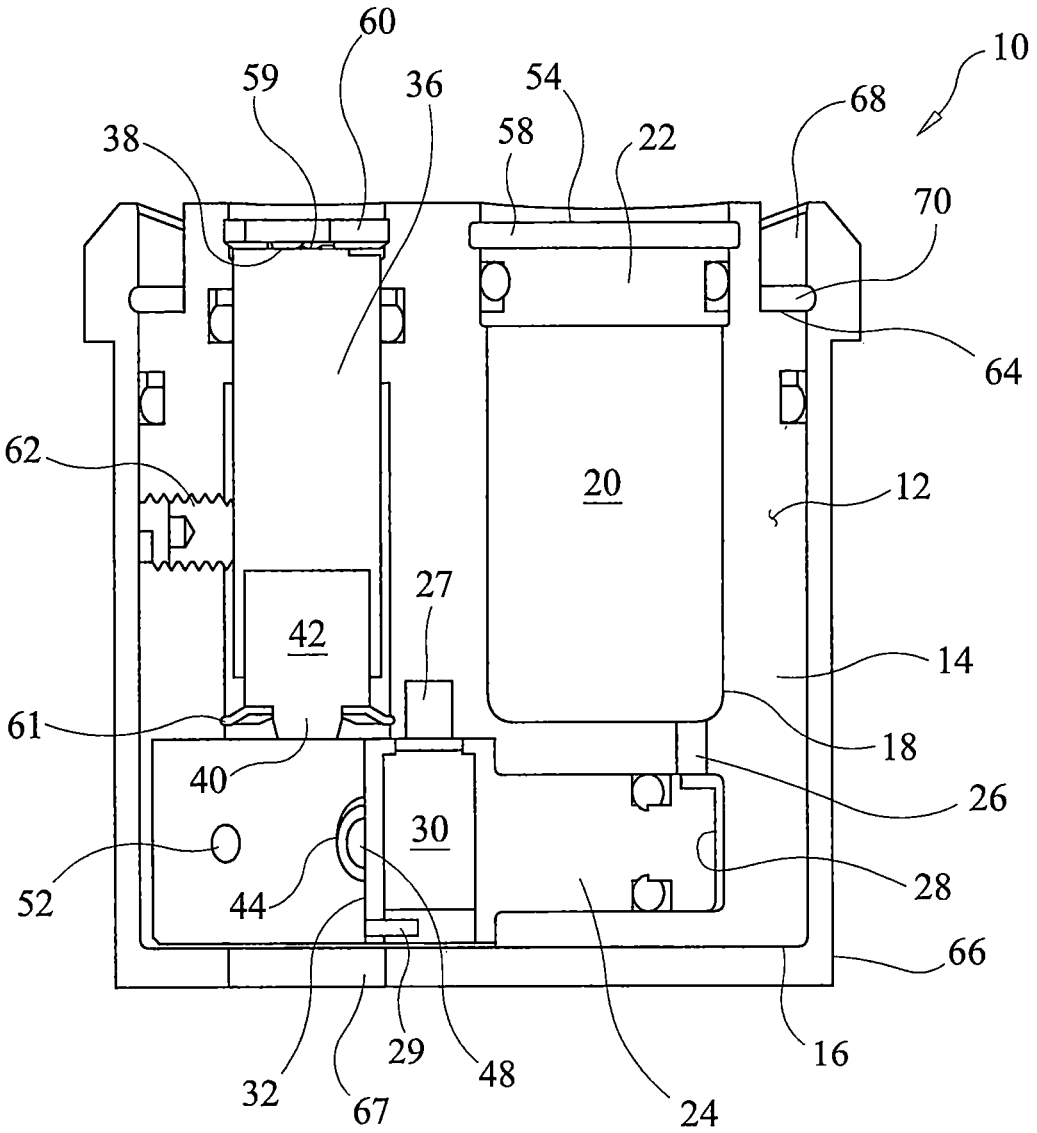
FIG. 1 is a sectional side view of one embodiment of an active hazard mitigation device.
Figure 2:
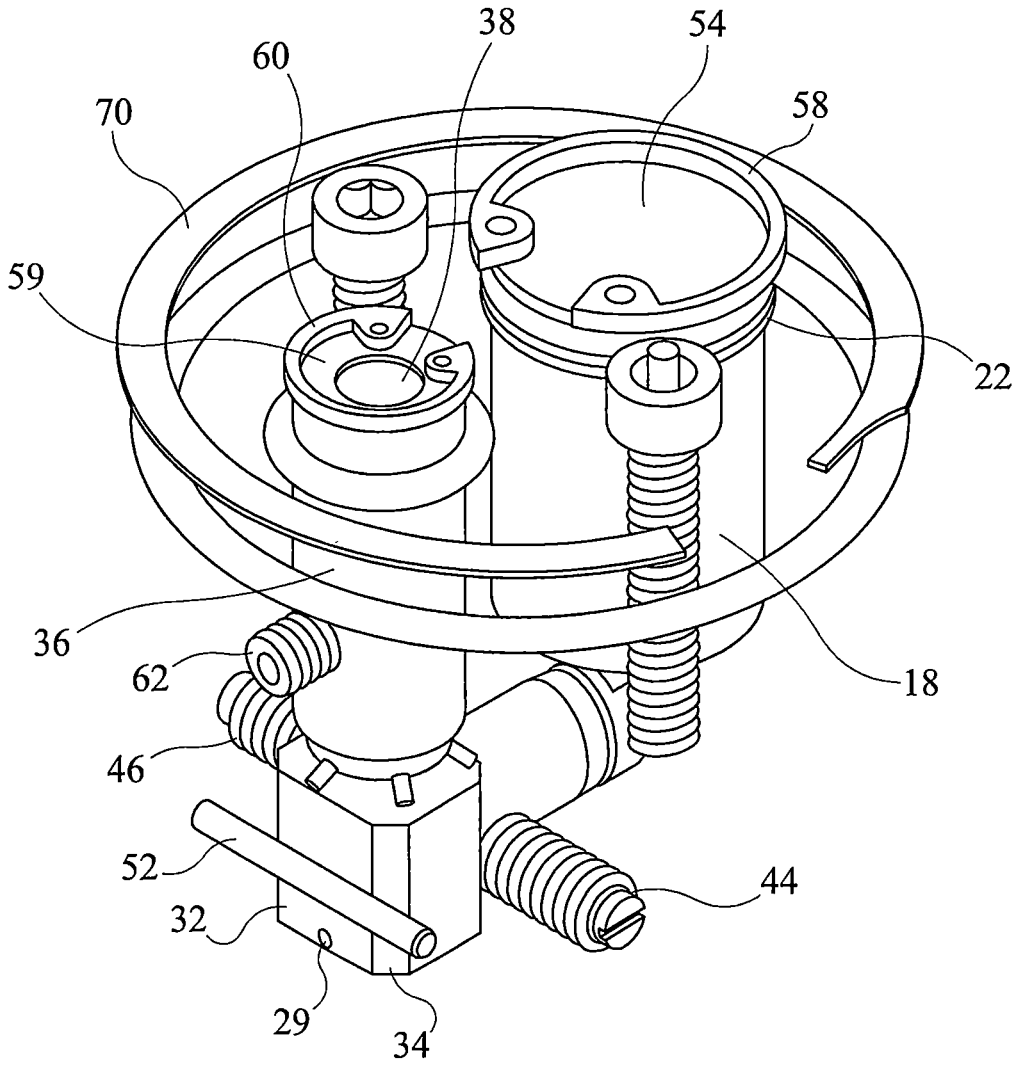
FIG. 2 is a perspective view of the components in the interior of the housing of the embodiment of FIG. 1, with the housing omitted.

FIG. 1 is a sectional side view of one embodiment of an active hazard mitigation device 10 having a generally cylindrical housing 12 with an interior 14 and an exterior 16. FIG. 2 is a perspective view of the components in the interior 14 of the housing 12 of the embodiment of FIG. 1, with the housing 12 omitted. A reservoir 18 is defined in the interior 14 of the housing 12 and contains thermal wax 20. One end of the reservoir 18 is closed with a cap 22. A slider 24 is disposed in the interior 14 of the housing 12 and is translatable from a safe position (FIG. 1) to an armed position (FIG. 2). A conduit 26 extends from the end of the reservoir 18 opposite the cap 22 to the rear of the safe position of the slider 24. The conduit 26 and the rear of the slider 24 also contain thermal wax. When the thermal wax 20 reaches its melting point, the thermal wax expands and flows through the conduit 26 to the rear of the slider 24 thereby moving the slider 24 to the armed position shown in FIG. 2.

Figure 3A:
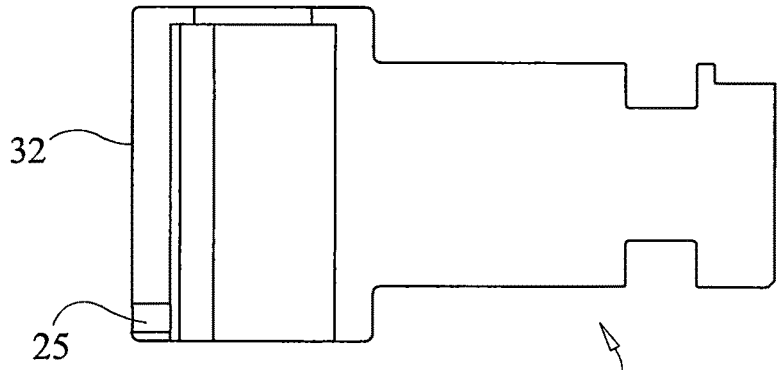
FIGS. 3A, 3B, and 3C are side, top perspective, and bottom perspective views, respectively, of an embodiment of a slider.
Figure 3B:
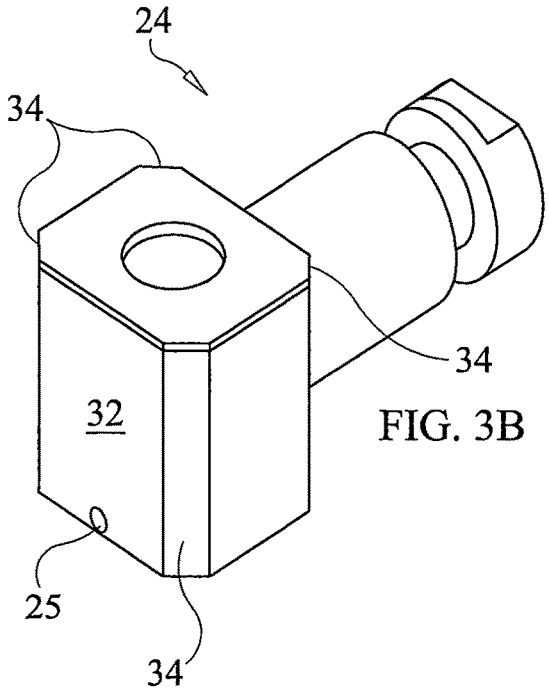
Figure 3C:
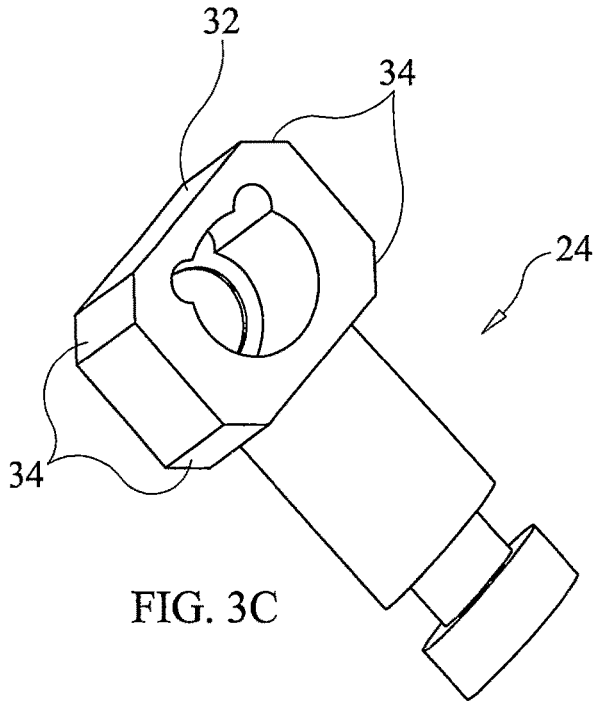
Figure 4A:
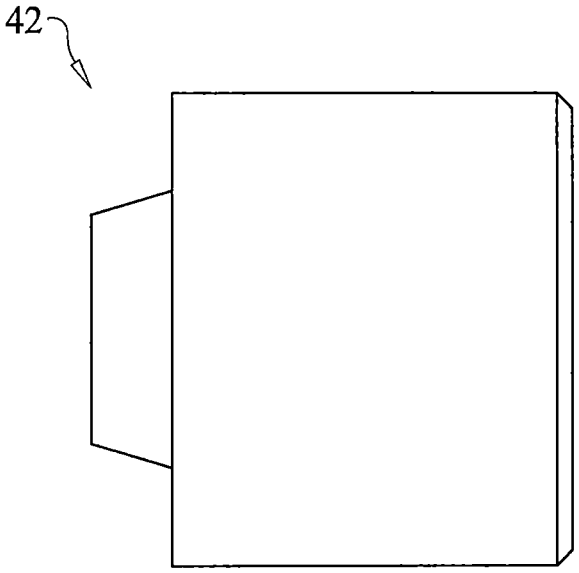
FIGS. 4A and 4B are side and perspective views, respectively, of a graphite thermal conductor.
Figure 4B:
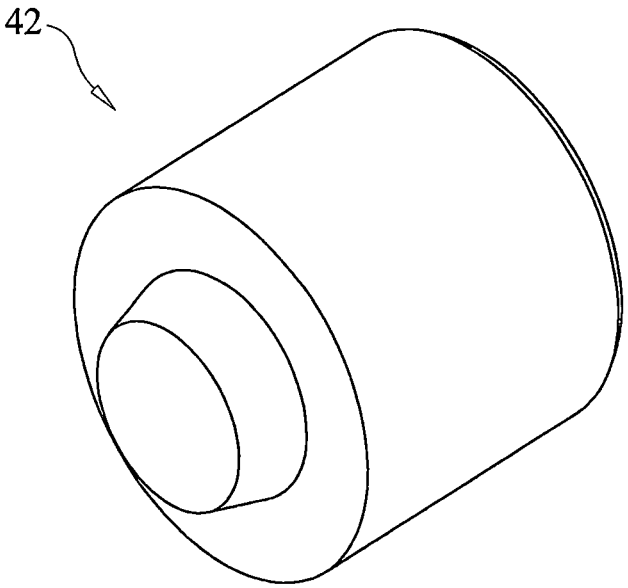

A $BKNO_3$ pellet 30 is disposed in a forward end 32 of the slider 24. The forward end 32 of the slider 24 has a generally rectangular prismatic shape with four parallel chamfered edges 34 (FIGS. 3B and 3C). A lithium intermetallic thermal sensor 36 is disposed in the interior 14 of the housing 12 and has a closed end 38 and an open end 40. The open end 40 is adjacent the $BKNO_3$ pellet 30 when the slider 24 is in the armed position. A graphite thermal conductor 42 is disposed in the open end 40 of the lithium metallic thermal sensor 36. FIGS. 4A and 4B are side and perspective views, respectively, of the graphite thermal conductor 42. Graphite has low density and, therefore, a low thermal mass so the graphite does not absorb as much of the heat as it transfers, compared to more dense materials. Graphite is also an excellent thermal conductor.

At a first temperature, the thermal wax 20 expands and moves the slider 24 from the safe position to the armed position. In the armed position, the $BKNO_3$ pellet 30 in the slider 24 is positioned under the graphite thermal conductor 42 of the lithium intermetallic thermal sensor 36. The first temperature may vary depending on the application. For example, the first temperature may be in a range of about 150 degrees F. to about 300 degrees F. In an exemplary embodiment, the first temperature is about 225 degrees F.

A pair of positioning pins 44, 46 are disposed on opposite sides of the slider 24. Each pin 44, 46 has a spring-loaded ball detent 48 that interacts with the chamfered parallel edges 34 to hold the slider 24 in the safe position. When the slider 24 moves from the safe position to the armed position, movement of the slider depresses the ball detents 48 until the slider reaches the armed position at which point the ball detents 48 pop back out to hold the slider in the armed position.

The temperature may continue to increase from the first temperature to a second temperature. At the second temperature, the lithium intermetallic thermal sensor 36 activates and self-heats. The second temperature is greater than the first temperature. The second temperature may vary depending on the application. For example, the second temperature may be in a range of about 200 degrees F. to about 400 degrees F. In an exemplary embodiment, the second temperature is about 292 degrees F. Heat from the activated lithium intermetallic thermal sensor 36 is transferred by the graphite thermal conductor 42 to ignite the $BKNO_3$ pellet 30 in the slider 24. Gas and heat produced by the $BKNO_3$ pellet 30 ignites energetic material 50 (FIG. 7) disposed proximate to the $BKNO_3$ pellet, in the warhead or rocket motor. The slider 24 and lithium intermetallic thermal sensor 36 constitute two different operational mechanisms that function at different temperatures and function sequentially.

In the event the device 10 is not armed, that is, the wax 20 has not melted and the slider 24 is in the safe position, an inadvertent activation of the lithium intermetallic thermal sensor 36 will not initiate the $BKNO_3$ pellet 30 or the energetic material 50 below the slider. The interior 14 of the generally cylindrical housing 12 may define a void 27 over the safe position of the $BKNO_3$ pellet 30. The void 27 functions as a thermal insulator.

In some scenarios, the temperature may increase to the first temperature so that the wax 20 melts and expands and the slider 24 moves to the armed position. Then, rather than increasing, the temperature may decrease. In that case, the slider 24 will remain in the armed position because of the interaction of the ball detents 48 of the positioning pins 44, 46 with the chamfered parallel edges 34 of the slider, because the vacuum pressure is significantly lower than the expanding pressure.

A slider stop pin 52 limits translation of the slider 24 when the slider has reached the armed position. A thermochromic sticker 54 is attached to a top of the thermal wax reservoir cap 22 and is visible with the naked human eye. The thermochromic sticker 54 permanently changes appearance when the first temperature is reached and so is a visible indication that the device 10 is armed. The space in the slider 24 for the $BKNO_3$ pellet 30 is open on top and bottom. A thin film made of, for example, Metallized BoPET (Biaxially-oriented polyethylene terephthalate) may be disposed on the opposite flat exposed sides of the $BKNO_3$ pellet 30. The film reflects heat when the slider 24 is in the safe position but the film will break down when directly under the graphite thermal conductor 42 due to the heat from the lithium intermetallic thermal sensor 36. A pellet holding pin 29 is disposed in an opening 25 (FIGS. 3A and 3B) in the slider 24 and prevents the $BKNO_3$ pellet 30 from falling out of the slider.

Figure 5:
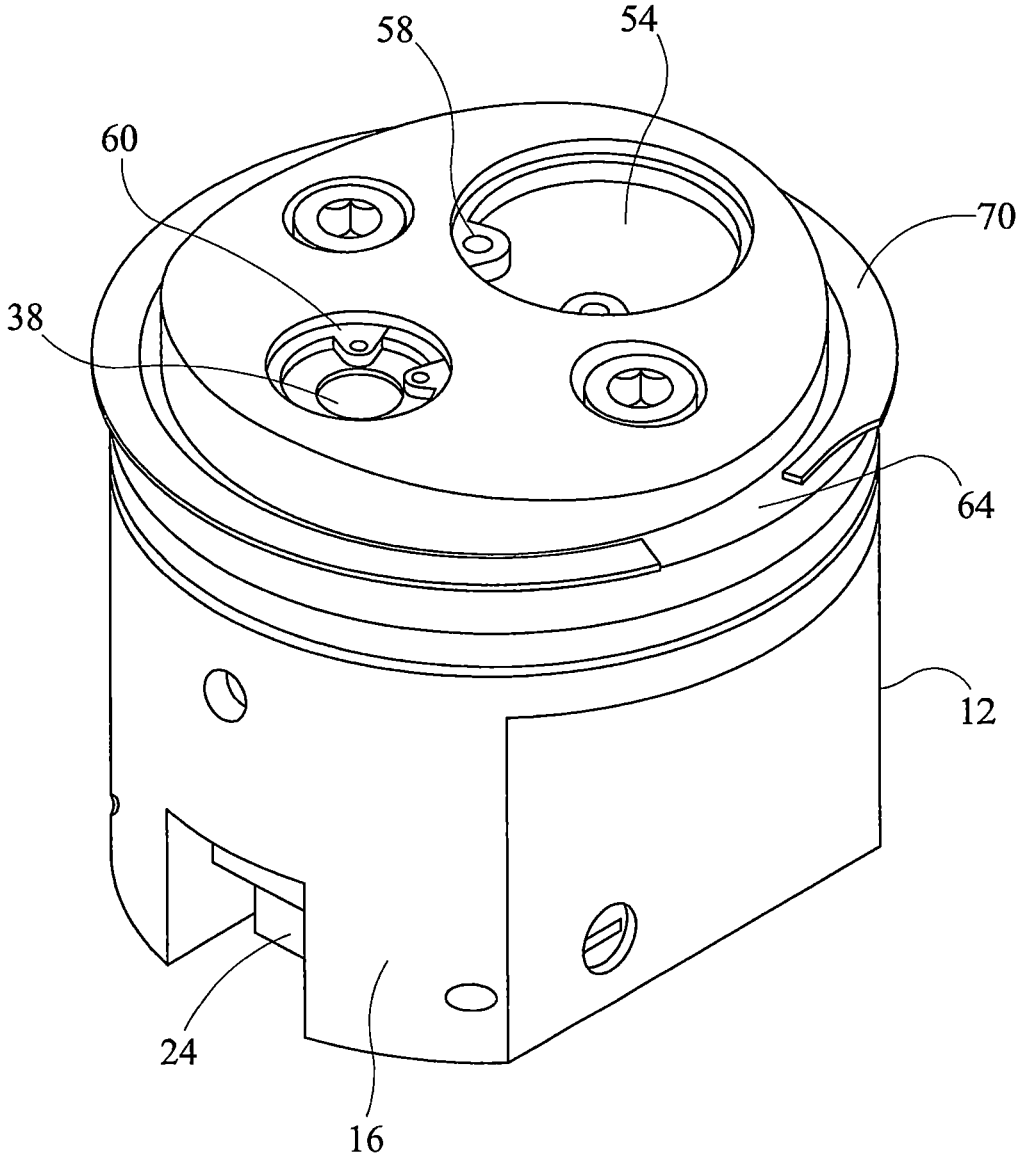
FIG. 5 is a perspective view of the exterior of the housing.

FIG. 5 is a perspective view of the exterior 16 of the generally cylindrical housing 12. The wax cap 22 may be fixed in the housing 12 with a C-clip 58. The lithium intermetallic thermal sensor 36 may be fixed in the housing 12 with a C-clip 60. The exterior 16 of the generally cylindrical housing 12 includes a circumferential flange 64 proximate an upper portion of the generally cylindrical housing.

Referring to FIG. 1, one or more wave washers 59 may be disposed between the C-clip 60 and the top of the lithium intermetallic thermal sensor 36 and a spring washer 61 may be disposed at the bottom of the graphite thermal conductor 42. The wave washer 59 and spring washer 61 ensure that the graphite thermal conductor 42 is in intimate contact with the lower face of the lithium intermetallic thermal sensor 36, while still being distanced from the walls surrounding the lithium intermetallic thermal sensor. This arrangement maximizes thermal conduction to the lower face of the graphite thermal conductor 42 and minimizes thermal losses to the sides of the graphite thermal conductor. The number of wave washers 59 may be varied to precisely control the vertical location of the lower end of the graphite thermal conductor 42 to thereby minimize the gap between the graphite thermal conductor and the top of the $BKNO_3$ pellet 30 when the slider 24 is in the armed position.

Figure 6A:
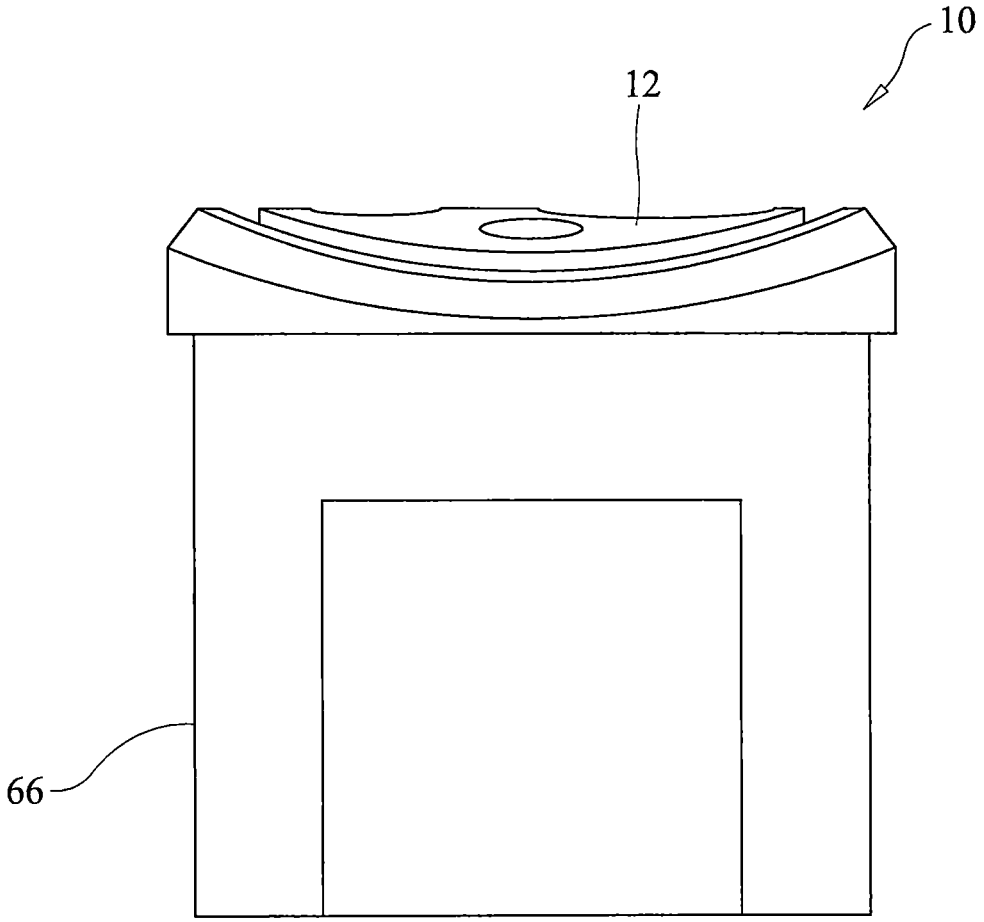
FIGS. 6A and 6B are side and perspective views, respectively, showing the housing disposed in a sleeve.
Figure 6B:
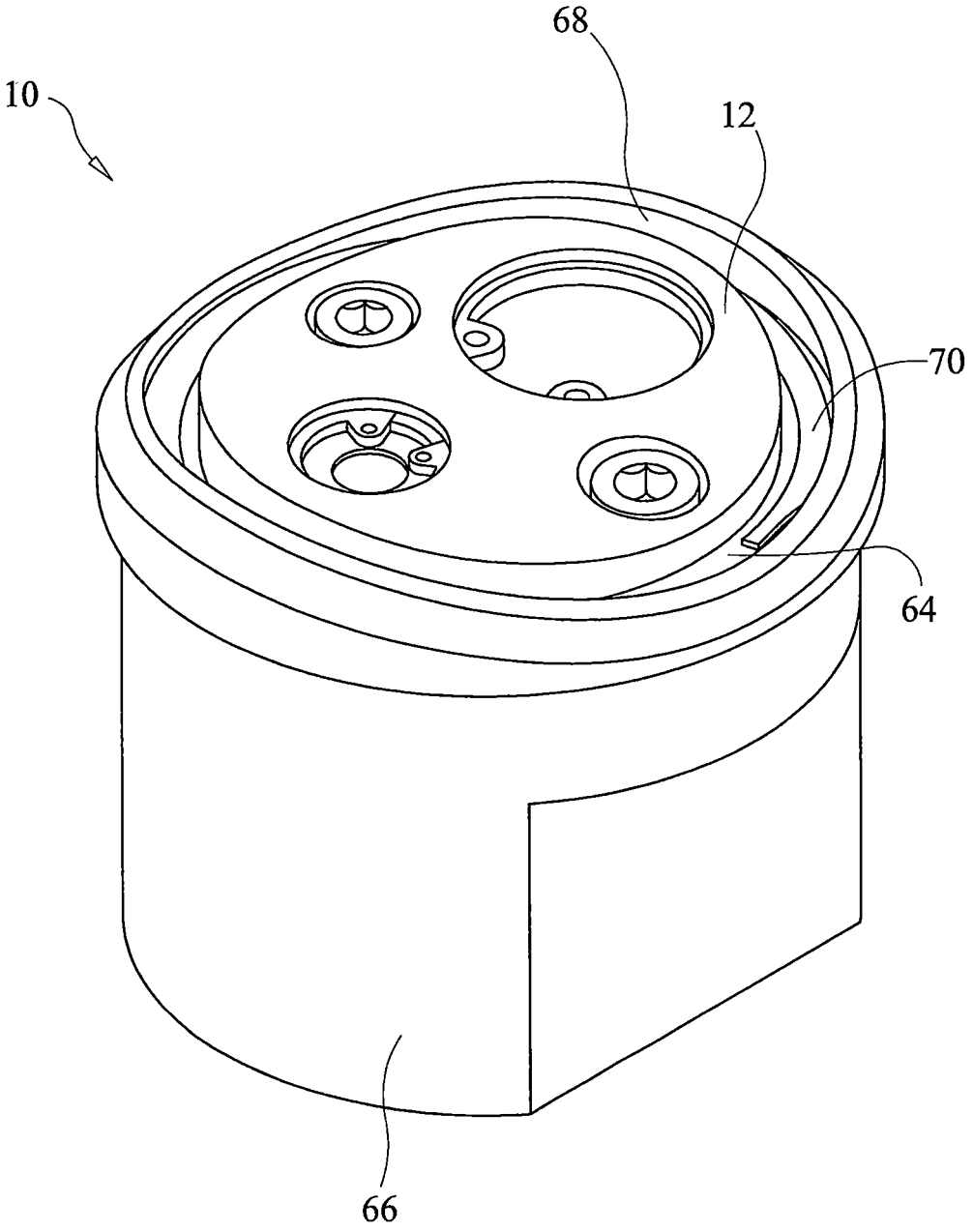

FIGS. 6A and 6B are side and perspective views, respectively, showing the generally cylindrical housing 12 and internal components disposed in a sleeve 66. Sleeve 66 and housing 12 may be made of a metal, for example, aluminum, aluminum alloys, titanium, titanium alloys, etc. The sleeve 66 fits around the exterior 16 of the generally cylindrical housing 12. The top of the sleeve 66 includes a circumferential lip 68 adjacent the circumferential flange 64. The circumferential lip 68 angles radially inward away from the outer circumference of the circumferential flange 64 to form a bevel, and cooperates with the circumferential flange 64 to hold a C-clip 70 that resists movement of the generally cylindrical housing 12 out of the sleeve 66.

Figure 7:
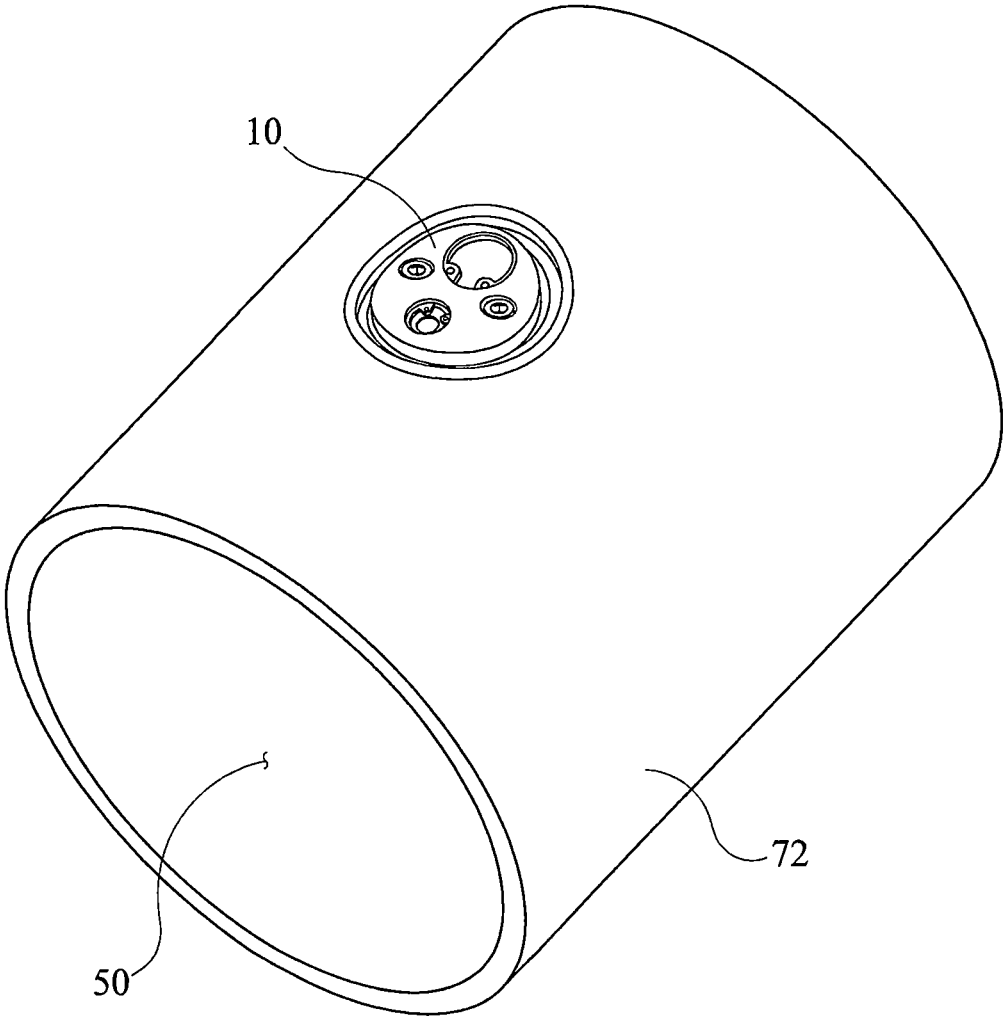
FIG. 7 is a perspective view of an active hazard mitigation device mounted in the side of a portion of a casing of a container for energetic material.

FIG. 7 is a perspective view of an active hazard mitigation device 10 mounted in the side wall of a portion of a casing 72 that contains energetic material 50. The sleeve 66 is inserted into and fixed to a side wall of the casing 72. The casing 72 may be, for example, a warhead or a rocket motor filled with energetic material 50. The sleeve 66 may be welded to the casing 72 before the casing is filled with energetic material 50. After the casing 72 is filled with energetic material 50, the generally cylindrical housing 12 containing the components of the device 10 may then be inserted in the sleeve 66 and secured therein with the C-clip 70. The sleeve 66 that contains the housing 12 and device components may be in range of about 1-3 inches in diameter and about 1-2 inches high. In an exemplary embodiment, the sleeve 66 is about 1.6 inches in diameter and about 1.4 inches high.

Once the slider 24 is armed and the $BKNO_3$ pellet 30 is ignited by the lithium intermetallic thermal sensor 36, then heat, flame, and sparks from the $BKNO_3$ pellet 30 will ignite the energetic fill 50 in the casing 72 via an access hole 67 (FIG. 1) in the sleeve 66 below the bottom side of the armed slider 24. In some embodiments, the access hole 67 may be filled with loose $BKNO_3$ powder and the top and bottom of the access hole covered with the same type of thin film (for example, Metallized BoPET (Biaxially-oriented polyethylene terephthalate)) used on the $BKNO_3$ pellet 30. The loose $BKNO_3$ powder in the access hole 67 provides a backup in case the $BKNO_3$ pellet 30 alone does not ignite the energetic fill 50. When the pressure of the burning $BKNO_3$ pellet 30 and energetic material 50 in the casing 72 reach a threshold pressure, the entire housing 12 and internal components therein will be ejected from the warhead or motor casing 72 in which it is mounted. The bevel of the circumferential lip 68 makes it easier for the pressure to eject the housing 12. The bevel will compress the C-clip 70 when the housing 12 is pushed upward from pressure. In an exemplary embodiment, the pressure threshold is about 1000 psi. Combustion products from the energetic material in the casing 72 may then be initially vented through the access hole 67 in the sleeve 66. The exiting hot gasses will melt the material of the sleeve 66 and enlarge the access hole 67 thereby preventing a high order detonation of the energetic material.

Finally, any numerical parameters set forth in the specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of significant digits and by applying ordinary rounding.

What is claimed is:

1. An active hazard mitigation device, comprising:

a generally cylindrical housing having an interior and an exterior;

a reservoir defined in the interior of the housing and containing thermal wax, one end of the reservoir being closed with a cap;

a slider being disposed in the interior of the housing and translatable from a safe position to an armed position;

a conduit for flow of the thermal wax in a melted state, the conduit extends from an end of the reservoir opposite the cap to a rear of the safe position of the slider;

a $BKNO_3$ pellet being disposed in a forward end of the slider, the forward end of the slider having a generally rectangular prismatic shape with four parallel edges that are chamfered;

a lithium intermetallic thermal sensor being disposed in the interior of the housing and having one end closed and an open end adjacent the $BKNO_3$ pellet when the slider is in an armed position;

a graphite thermal conductor being disposed in the open end of the lithium intermetallic thermal sensor; and a pair of positioning pins being disposed in the interior of the housing on opposite sides of the slider, each pin having a spring-loaded ball detent wherein the spring-loaded ball detents interact with the chamfered parallel edges to hold the slider in the safe position and, after arming of the active hazard mitigation device, to hold the slider in the armed position, wherein when the thermal wax expands at a first temperature, the slider is configured to move from the safe position to the armed position under the graphite thermal conductor of the lithium intermetallic thermal sensor, and wherein when the lithium intermetallic thermal sensor activates and self-heats at a second temperature that is greater than the first temperature, heat from the lithium intermetallic thermal sensor is transferred by the graphite thermal conductor to ignite the $BKNO_3$ pellet in the slider and thereby produce gas and heat that ignites energetic material disposed proximate to the $BKNO_3$ pellet.

2. The device of claim 1, further comprising a slider stop pin being disposed in the interior of the housing for limiting translation of the slider when the slider has reached the armed position.

3. The device of claim 1, further comprising a thermochromic sticker being attached to a top of the thermal wax reservoir cap and visible with a naked human eye, wherein the thermochromic sticker permanently changes appearance when the first temperature is reached.

4. The device of claim 1, further comprising metallized BoPET (Biaxially-oriented polyethylene terephthalate) film being disposed on opposite flat ends of the $BKNO_3$ pellet.

5. The device of claim 1, wherein the exterior of the generally cylindrical housing includes a circumferential flange proximate an upper portion of the generally cylindrical housing.

6. The device of claim 5, further comprising a sleeve that fits around the exterior of the generally cylindrical housing; and a top of the sleeve including a circumferential lip adjacent the circumferential flange wherein the circumferential lip angles radially inward and cooperates with the circumferential flange to hold a C-clip that resists movement of the generally cylindrical housing out of the sleeve.

7. The device of claim 6, wherein the sleeve is inserted into and fixed to a side wall of a casing for holding energetic material.

8. The device of claim 1, wherein the first temperature is in a range of about 150 degrees F. to about 300 degrees F.

9. The device of claim 8 wherein the second temperature is in range of about 200 degrees F. to about 400 degrees F.

10. A method to ignite and vent energetic material disposed in a casing, comprising:

installing the device of claim 5 in a sleeve fixed to a side wall of the casing;

expanding the thermal wax at a first temperature;

moving the slider from the safe position to the armed position under the graphite thermal conductor of the lithium intermetallic thermal sensor;

activating the lithium intermetallic thermal sensor at a second temperature that is greater than the first temperature;

transferring heat from the lithium intermetallic thermal sensor via the graphite thermal conductor to ignite the $BKNO_3$ pellet in the slider;

igniting the energetic material in the casing via the gas and heat produced by the $BKNO_3$ pellet and the lithium intermetallic thermal sensor; and ejecting the generally cylindrical housing from the sleeve as pressure in the casing increases.

11. The method of claim 10, wherein said ejecting the generally cylindrical housing includes ejecting the generally cylindrical housing when the pressure reaches about 1000 psi.

* * * * *